US005351763A

United States Patent [19]

Muuttonen

[11] Patent Number: 5,351,763

[45] Date of Patent: Oct. 4, 1994

[54] ARRANGEMENT FOR AN AXIAL BEARING IN A DRILLING MACHINE

[75] Inventor: Timo Muuttonen, Siuro, Finland

[73] Assignee: Tamrock OY, Tampere, Finland

[21] Appl. No.: 916,838

[22] PCT Filed: Feb. 18, 1991

[86] PCT No.: PCT/FI91/00049

§ 371 Date: Aug. 14, 1992

§ 102(e) Date: Aug. 14, 1992

[87] PCT Pub. No.: WO91/12934

PCT Pub. Date: Sep. 5, 1991

[30] Foreign Application Priority Data

Feb. 23, 1990 [FI] Finland ..... 900937

[51] Int. Cl.[5] ..... B25D 17/24

[52] U.S. Cl. ..... 173/210; 173/105; 92/85 R

[58] Field of Search ..... 173/210, 212, 105; 92/85 R, 85 B

[56] References Cited

U.S. PATENT DOCUMENTS

| | | | |
|---|---|---|---|
| 2,791,097 | 5/1957 | Smith | 173/212 X |
| 4,343,368 | 8/1982 | Fadeev et al. | 173/212 |
| 4,871,035 | 10/1989 | Ekwall | 173/212 |
| 4,934,465 | 6/1990 | Salmi et al. | 173/210 |
| 4,993,504 | 2/1991 | Rodert et al. | 173/212 X |

FOREIGN PATENT DOCUMENTS

| | | |
|---|---|---|
| 2738956 | 3/1979 | Fed. Rep. of Germany . |
| 2610619 | 11/1979 | Fed. Rep. of Germany . |
| 57547 | 5/1980 | Finland . |
| 58816 | 12/1980 | Finland . |
| 861851 | 11/1987 | Finland . |
| 760664 | 3/1983 | Sweden . |
| 8100961 | 8/1985 | Sweden . |
| 458672 | 4/1989 | Sweden . |

*Primary Examiner*—Rinaldi I. Rada
*Attorney, Agent, or Firm*—Nixon & Vanderhye

[57] ABSTRACT

The invention relates to an arrangement for an axial bearing in a drilling machine. The drilling machine includes a frame (6), a percussion device (1) fitted in the frame, and a shank (2) positioned on an axial extension of the percussion device. The frame (6) further includes an axial bearing formed by a number of pistons (4*a*, 4*b*) to receive axial forces acting on the frame (6) through the shank (2). The length of travel of some pistons (4*b*) towards the forward portion of the drilling machine is limited so that when they are in their forward position and the shank (2) is supported by the pistons (4*a*, 4*b*), the shank (2) is substantially at its optimal percussion point.

8 Claims, 4 Drawing Sheets

ARRANGEMENT FOR AN AXIAL BEARING IN A DRILLING MACHINE

TECHNICAL FIELD

BACKGROUND AND SUMMARY OF THE INVENTION

The invention relates to an arrangement for an axial bearing in a drilling machine comprising a frame; a percussion device fitted in the frame; a shank positioned on an axial extension of the percussion device; means for rotating the shank; and an axial bearing fitted in the frame to receive axial forces acting on the frame through the shank, the axial bearing being formed by several pistons accommodated in axial housings formed in the frame along a periphery circumscribing the shank and interconnected with a conduit system, the pistons being further arranged to act on the shank so as to force it towards the forward portion of the drilling machine under the influence of a hydraulic fluid acting on the back surface of the pistons.

In hydraulic percussion drilling machines presently in use, the percussion device fitted in the frame is intended to apply successive axial impacts on a shank attached to a drill rod. The shank is mounted rotatably and axially slideably to the frame e.g. by a frame bushing which is in engagement with a rotation mechanism supported by the frame. The frame in turn is secured to a feed carriage on which the drilling machine is displaced along the feed rail of the drilling equipment.

On drilling a rock, an impact impulse is reflected from the rock to the drilling machine, and the force caused by the impulse has to be received in the drilling machine somehow. For this purpose, various flexible axial bearing arrangements have been developed for drilling machines to protect them against reflected impact-like stress impulses. Such arrangements include those disclosed in FI Patent Specification 58816, DE Auslegeschrift 2 738 956, SE Published Specification 440 873 and DE Offenlegungsschrift 2 610 619.

These flexible axial bearing arrangements known from the prior art have the drawback of being complicated, in addition to which they require a great number of seals and enable no adjustment of flexibility, that is, the rigidity of the axial bearings is invariable. A further drawback is that the flexing phenomenon occurs with a delay and depends on the feed power applied to the drilling machine.

FI Patent Application 861851 discloses an arrangement in which the axial bearing comprises several pistons positioned radially around the shank, whereby the pressure of a hydraulic fluid acts on one end of the pistons so that the pistons adjust the position of the shank within a predetermined area. In certain cases, however, it is necessary that the percussion point of the shank can be determined precisely in each particular case while maintaining the flexibility of the axial bearing, which cannot be fully accomplished with this arrangement.

The object of the present invention is to provide an arrangement for an axial bearing in a drilling machine which avoids the drawbacks of the prior art described above. This is achieved by means of an arrangement of the invention, which is characterized in that the length of travel of some of the pistons towards the forward portion of the drilling machine is limited so that when they are in their foremost position and the shank is supported by the pistons, the percussion surface of the shank is positioned substantially at its optimal percussion point, whereby the pressure of the hydraulic fluid acting on the back surface of the pistons at least during the drilling is arranged to be such that the total force exerted on the shank by all the pistons so as to force it forwards exceeds the feed force acting on the drilling machine during drilling.

An advantage of the arrangement of the invention is that when the pressure of the hydraulic fluid causes the pistons to travel forwards, some of the pistons stop in their foremost position, so that the shank is always positioned at its optimal percussion point when it is supported by the pistons. After the impact, however, some of the pistons are able to follow the shank during the percussion movement so that they deaden the return movement of the shank before it reaches the percussion point during the return impulse. When the shank reaches the percussion point, all the pistons deaden the return impulse efficiently. Whenever a new impact is to be made, the shank is always at the percussion point, since the force acting on the pistons is altogether greater than the feed force, whereas the feed force exceeds the total force produced by the pistons capable of following the shank after the movement of the pistons having their stroke length limited to the percussion point has stopped. A further advantage of the invention is that it is simple to manufacture and the pistons of different stroke length are very simple to construct and hence economical to manufacture.

In the following the invention will be described in greater detail by means of certain preferred embodiments shown in the attached drawings.

DETAILED DESCRIPTION OF THE DRAWINGS

Figures 1, 2:
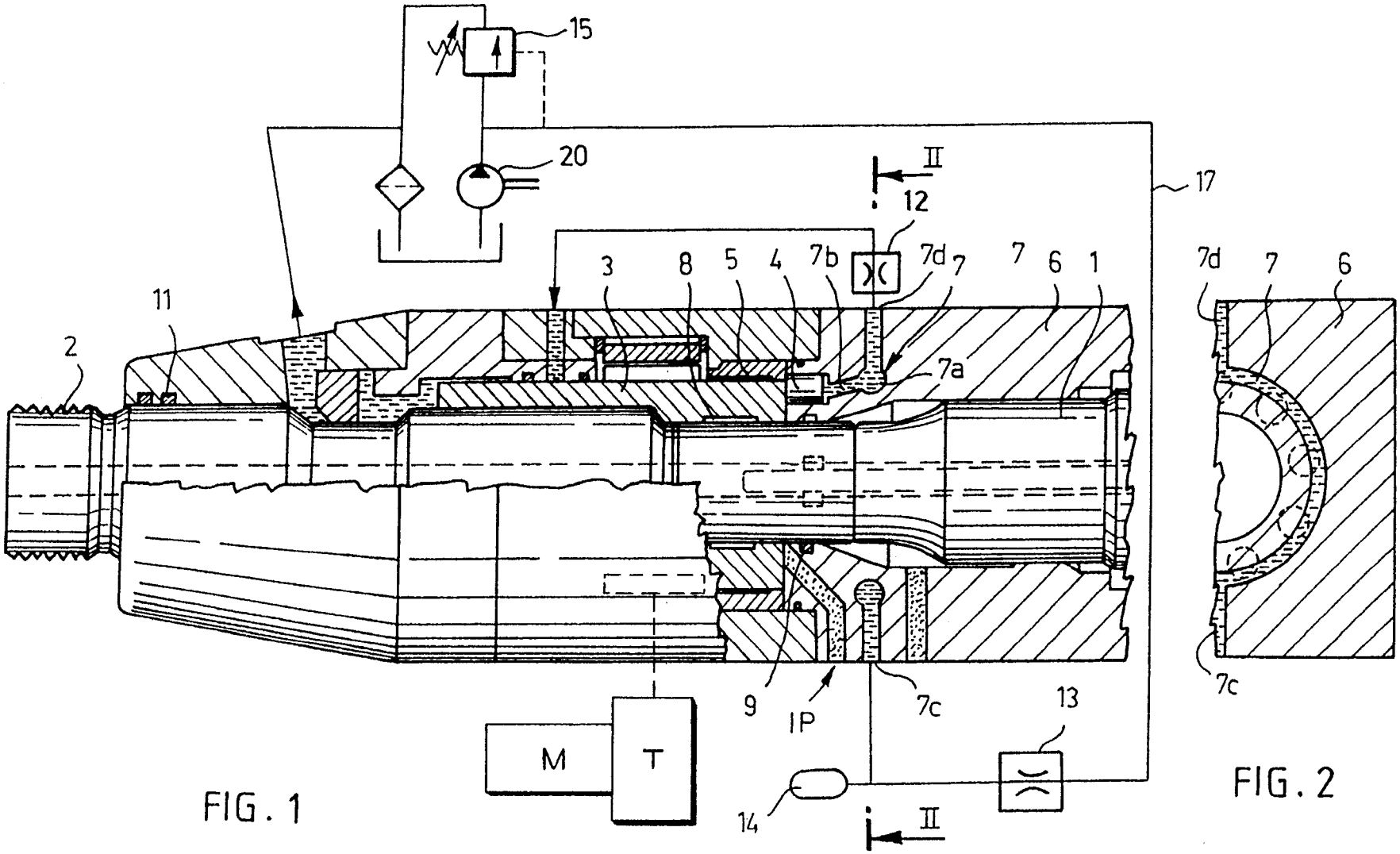
FIG. 1 is a side view of the principal features of a drilling machine provided with an axial bearing arrangement of the invention.
FIG. 2 is a sectional view taken along the arrows II—II of FIG. 1.

In the example of FIG. 1, a percussion piston 1 moves within a frame 6 formed by a number of components in a manner known per se. A shank 2 is secured to the frame by means of a rotatable and axially movable frame bushing 3. A separate hydraulic motor M imparts a rotational movement to the shank 2 through a gear transmission T. The hydraulic motor and the gear transmission, which are known per se, are shown schematically in FIG. 1. The outer periphery of the frame bushing 3 is provided with teeth which are engageable with the above-mentioned gear. The inner surface of the frame bushing 3 is provided with an engaging gearing which is axially movable with respect to the gearing of the shank. The frame bushing 3 is journalled radially along its outer periphery to the frame 6 at its both ends.

These matters are known per se to one skilled in the art, so their details or operation require no further discussion herein.

For receiving impact impulses reflecting from the rock to the drilling machine, the frame 6 is provided with an axial pressure bearing which is made flexible by arranging it to move axially under the influence of a hydraulic fluid acting on it. The axial bearing is formed by several pistons 4*a*, 4*b* which are fitted in axial housings provided in the frame along a periphery circumscribing the shank 2 and which are interconnected with a conduit system 7. This structure appears particularly clearly from FIG. 2.

As can be seen from FIG. 1, the conduit system 7 is arranged to open to the bottom of each housing behind the piston fitted in the housing as viewed in the direction of feed of the drilling machine. The conduit system 7 is formed by a ring-shaped conduit 7*a*, conduits 7*b* leading from the conduit 7*a* to the housings, and an inlet and outlet conduit 7*c* and 7*d*, respectively. In the example of FIG. 1, a throttle means 12 adjusting the flow of lubricant to the gear part of the shank is fitted in the outlet conduit 7*d*. Hydraulic components adjusting the flow and pressure of the hydraulic fluid in the conduit system 7 of the axial bearing are connected to the inlet conduit 7*c*. These components will be described below.

The forward travel of the pistons 4*a*, 4*b* of the axial bearing is limited by a limiter ring 5 provided in the frame 6. The inner periphery of the limiter ring 5 is smaller than the periphery of an envelope drawn around the outer edges of the pistons 4*a*, 4*b*. The backward travel of each piston 4*a*, 4*b* is limited by the bottom of the respective housing. The shank 2 is supported by a separate support ring 8 provided behind it, and the backward surface of the support ring 8 bears on the forward surfaces of the pistons 4*a*, 4*b*. Since the pistons 4*a*, 4*b* are fitted in place without seals, leakage of hydraulic fluid will occur, so that the escape of the fluid into the percussion space is prevented by a seal 9. The seal 9 is positioned at the backward end of the shank in the frame 6. The escape of oil serving as a hydraulic fluid from the forward portion of the frame 6 is prevented with a seal 11. As used above, the term forward refers to movement in the direction of feed of the drilling machine, and the term backward refers correspondingly to movement opposite to the direction of feed, etc.

The structure and lubrication of the gear portion of the frame bushing 3 and the shank 2 may be such as disclosed in FI Patent Specification 66459, for instance. As to the lubrication, it is merely to be mentioned herein that air is applied in front of the seal 9 to the back end of the shank 2. In FIG. 1, the blowing of air is indicated with the reference IP. The function of the air is to convey oil to points to be lubricated onto the bearings and to level out flow variations and to prevent cavitation. Air is removed from the oil before the oil is filtered and passed into a tank.

The axial bearing used in the embodiment of FIG. 1 is shown on a larger scale in FIGS. 3 to 8. The invention will be described below with reference to these figures.

Figure 3:
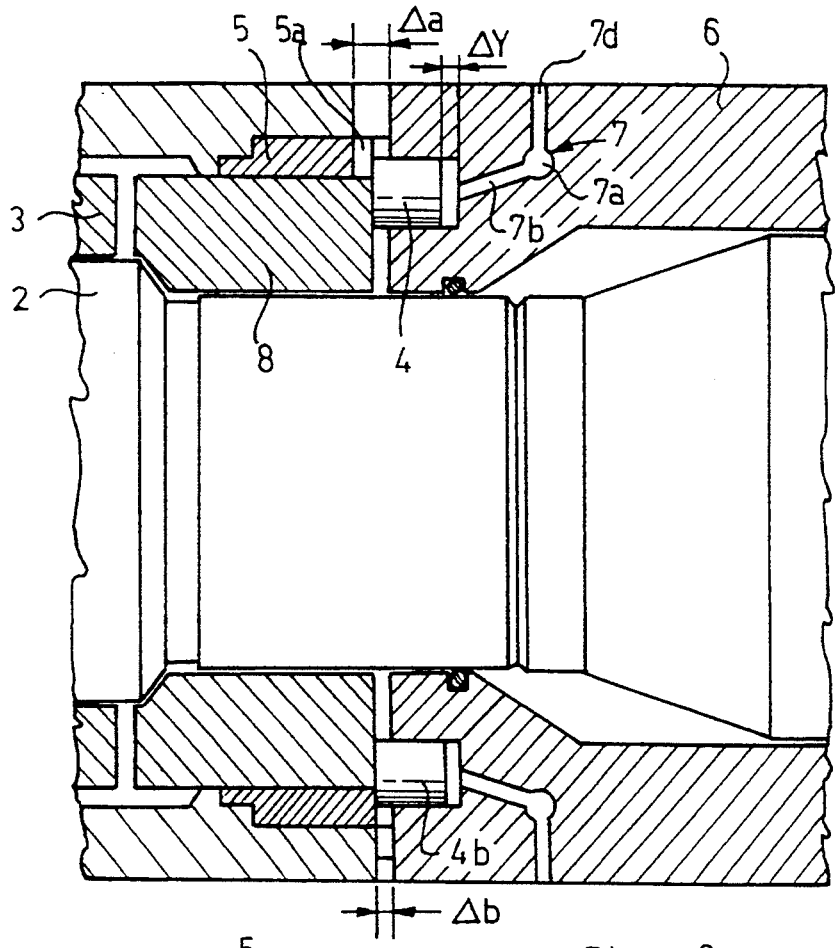
FIG. 3 shows the arrangement of the invention on a larger scale.

In FIG. 3, the limited range of travel of the pistons 4*a* and 4*b* is indicated with the reference Δa and Δb, respectively. As used herein, the term limited range of travel refers to the axial range of travel of the piston. This range of travel is limited by the limiter ring 5 and the bottom of the respective housing, as mentioned above. In the invention, the range of travel of the pistons 4*a* and the range of travel of the pistons 4*b* are so limited towards the forward portion of drilling machine that they are unequal: the limiter ring 5 comprises recesses 5*a* into which the pistons 4*a* are able to move over a longer distance towards the forward end of the drilling machine than the pistons 4*b*. In FIG. 3, the pistons 4*a* and the pistons 4*b* are in a position ΔY as measured from the bottom of the housing. Pressure applied to the conduit system 7 exerts a force on the pistons 4 so that each piston 4*b* bears on the support ring 8, which in turn bears on the shank 2. This situation is illustrated in FIG. 3. As the force produced by the pressure of the hydraulic fluid acting on the pistons 4*a* and 4*b* is greater than the feed force of the drilling machine during the drilling process, the pistons 4*a* and 4*b* have moved forwards so far that the pistons 4*b* bear on an abutment surface on the limiter ring 5. The percussion surface of the shank 2 and hence the shank are at an optimal percussion point in view of the transmission of the impact power and is not able to move farther as the force acting on the shank through the pistons 4*a* is smaller than the feed force acting on the drilling machine due to the prevention of the travel of the pistons 4*b*, so that this force is not able to force the shank forwards beyond the percussion point. After the shank 2 has moved backwards up to the percussion point, the pistons 4*b* having the more limited range of travel receive the support ring 8 of the shank, and when the shank further moves backwards under the influence of the return impulse, the combined force of the pistons 4*a* and 4*b* deadens the return movement, which rapidly stops the return impulse.

Figure 4:
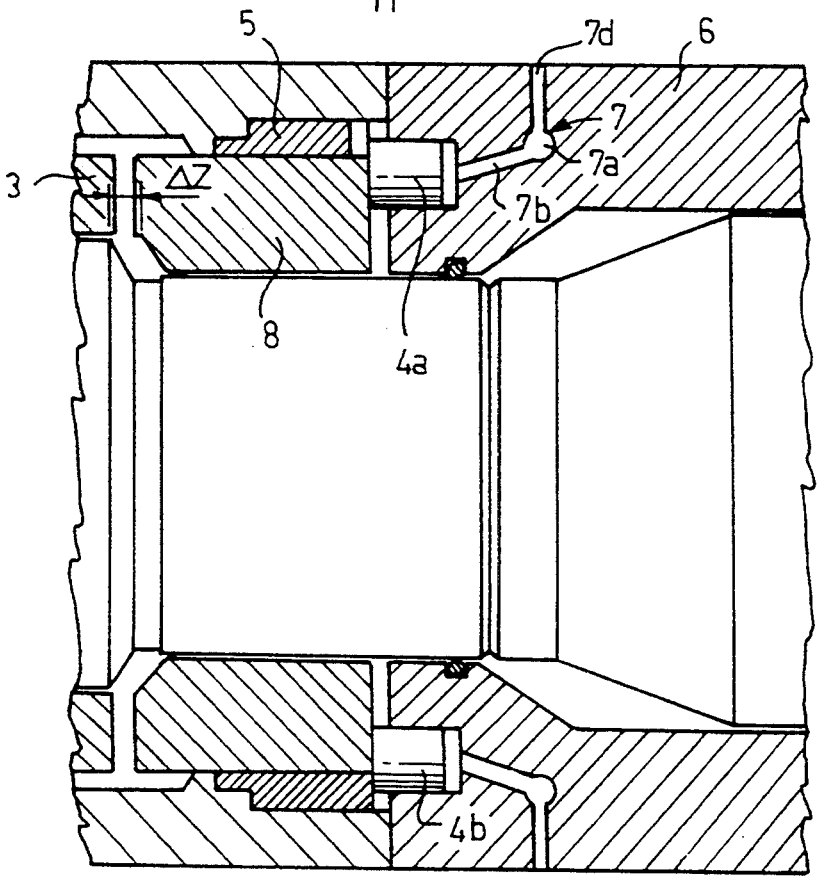
FIG. 4 illustrates the arrangement of FIG. 3 after an impact made by a percussion piston.

The impact of the percussion piston 1 on the end of the shank 2 causes a rapid steplike displacement ΔZ of the shank. This situation is illustrated in FIG. 4.

Figure 5:
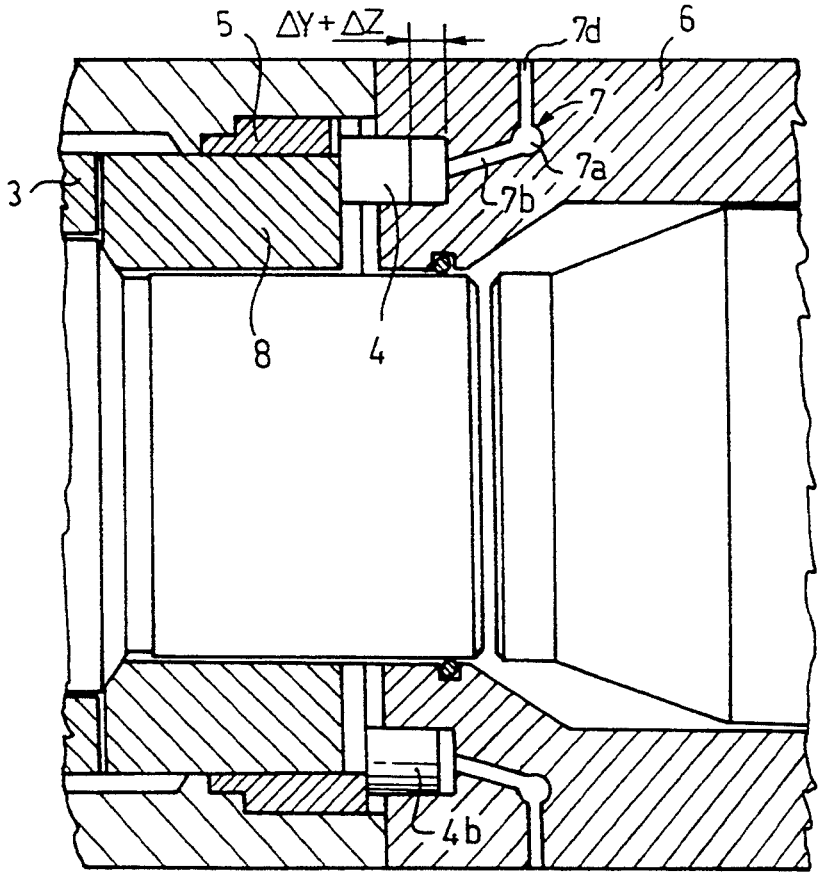
FIG. 5 illustrates the arrangements of FIGS. 3 and 4 at the initial stage of the return impulse of the shank.

After this situation, the pistons 4*a* displace the support ring 8 so that it follows rapidly the movement of the shank 2 in such a way that it is again pressed against the shank 2. This situation is illustrated in FIG. 5.

Figure 6:
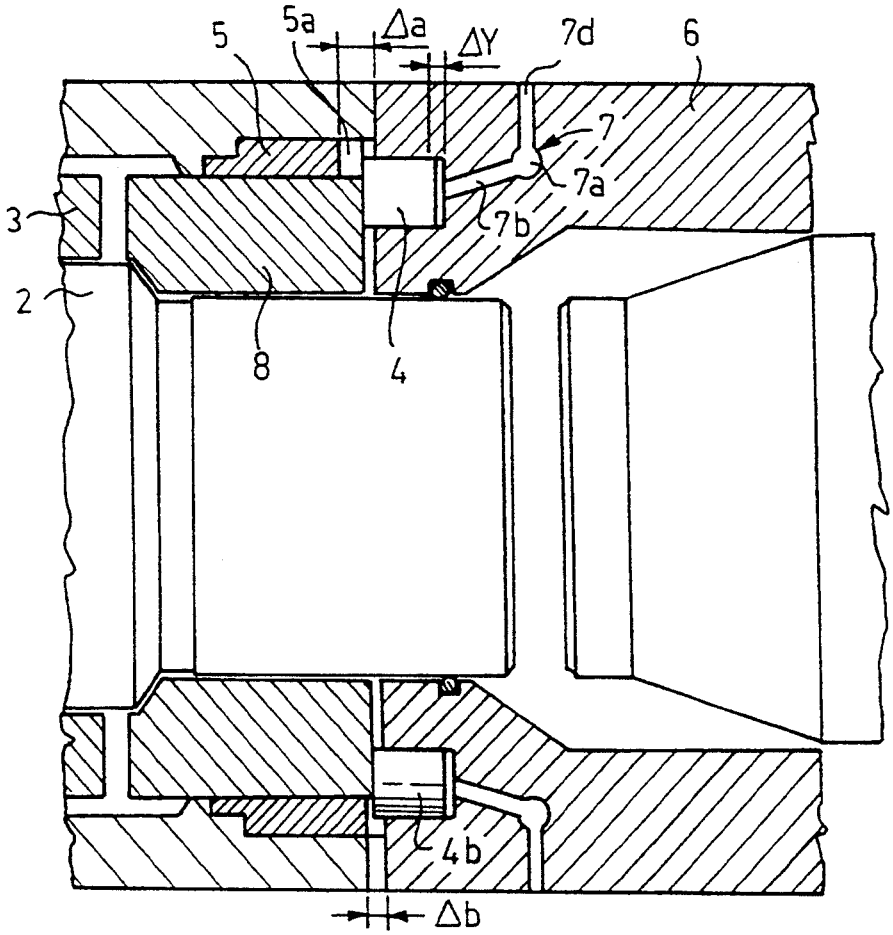
FIG. 6 illustrates the arrangement of FIGS. 3 and 4 at the final stage of the return impulse.

After the impact produced by the percussion piston 1, the stress impulse reflecting from the rock causes a rapid steplike displacement of the shank 2, though in a direction opposite to that described above. On receiving the reflected impulse, the support ring 5 is, however, in the position shown in FIG. 5, so that the axial movement of the shank 2 is received by the flexible pistons 4*a* of the axial bearing. The pistons 4*a* deaden the backward movement of the shank until the back surface of the support ring 8 strikes on the front surface of the pistons 4*b* having the more limited range of travel, whereafter both the pistons 4*a* and the pistons 4*b* limit the movement of the shank as shown in FIG. 6. Since the pistons 4*a* and 4*b* and the support ring 8 follow the movements of the shank nearly without delay, the reflection impulse acting on the shank 2 can be received by the pistons of the axial bearing irrespective of the delay in the entry of the reflection impulse. Thereafter the pistons 4*a* and 4*b* again force the shank back to the percussion point-for a new impact, as shown in FIG. 3.

FIG. 1 shows one preferred hydraulic connection, by means of which the above operation can be accomplished. A hydraulic liquid used as a pressure fluid is introduced by means of a pump 20 through a conduit 17 to the inlet conduit 7*a* through the throttle means 13. The desired operation is achieved by adjusting the pressure of the system to a suitable level by means of a pressure regulation valve 15. The speed of the pistons 4*a* and 4*b* is accomplished by a pressure accumulator 14 which pressurizes the conduit system 7 while the throttle means 13 reduces the flow of liquid in the direction towards the pump 20.

Figure 7:
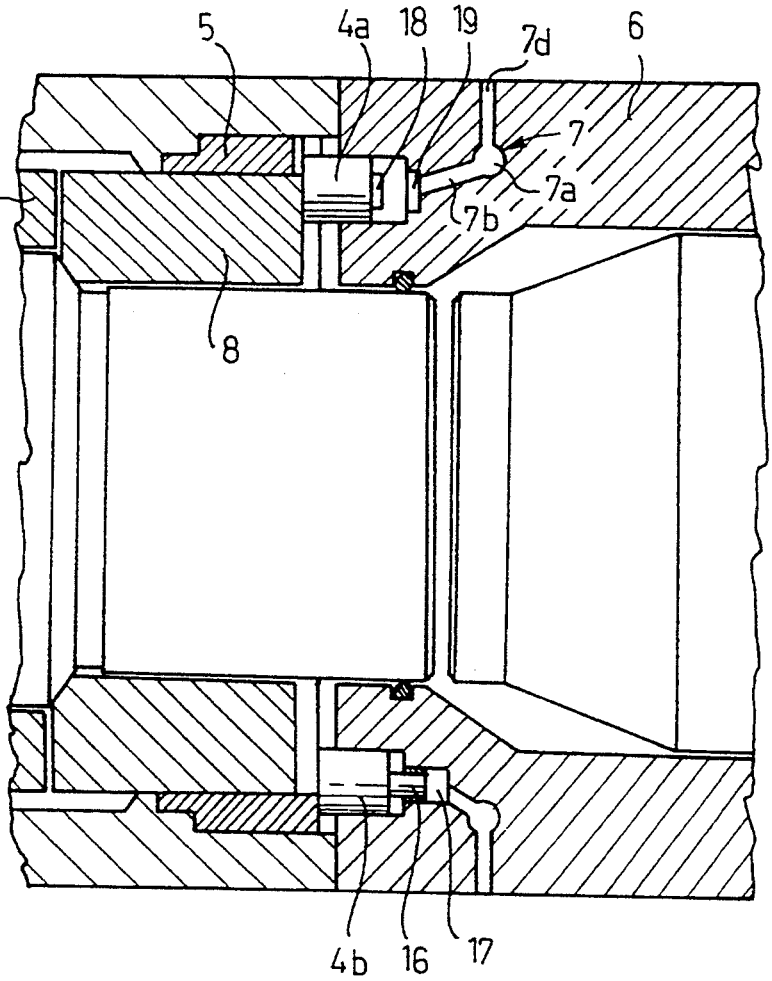
FIG. 7 illustrates another embodiment in which the back portion of the pistons is provided with a throttle means for increasing the reflection effect either continuously during the return movement or when the return movement extends farther back than usual.

In the arrangement shown in FIG. 7, a bar-like projection 16 extending into a recess 17 formed in the conduit 7*b* is provided in the back surface of the piston 4*b*. A gap remaining between the projection 16 and the recess 17 serves as a throttle for liquid escaping from behind the piston 4*b* and correspondingly throttles the flow of liquid behind the piston to some extent when the piston travels forwards. The properties and possible progressiveness of the throttle can be affected by varying the length and shape of the projection 16. In the same way it can be determined at which point along the path of the piston the throttle begins to act. The projection can be shaped so that it tapers away from the piston 4*b*, so that the gap is larger at first and decreases as the piston 4*b* moves backwards, simultaneously increasing the effect of the throttle.

The piston 4*a* in turn comprises a short pinlike projection 18, a corresponding recess 19 being provided in alignment with the projection 18 at the inlet end of the conduit 7*b*. The recess is so dimensioned that a narrowish gap remains between the projection 18 and the recess 19. When the projection 18 reaches the edge of the recess 19, the flow of liquid begins to throttle, so that the striking of the piston 4*a* on the bottom of its recess is at least retarded and in most cases prevented due to the throttle effect.

The throttle means of FIG. 7 are possible alternatives but they can be modified in various ways. All the pistons can be provided with throttles which can be similar or dissimilar depending on the type of the piston. Furthermore, it is possible that only some of the pistons are provided with throttles, and different types of throttles can be used depending on the properties of the drilling machine.

Figure 8:
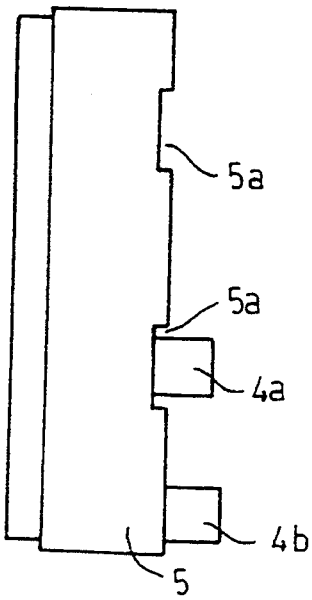
FIG. 8 is a side view of one embodiment of a limiter.

FIG. 8 is a side view of the limiter ring 5, in which a recess 5*a* is formed at every other piston 4*a*, for instance, in such a way that the piston 4*a* is able to move farther onwards than the piston 4*b* in the axial direction of the limiter ring 5 and thus in the axial direction of the drilling machine. For purposes of clarity, FIG. 8 shows only one piston 4*a* and one piston 4*b*. FIG. 8 illustrates a situation in which both pistons 4*a* and 4*b* have travelled so far forwards in the axial direction of the drilling machine as is possible for them. The piston 4*b* is thereby supported on the upper edge of the limiter ring 5 and the piston 4*a* on the bottom of the recess 5*a*, the upper edge and the bottom thus acting as abutment surfaces. As a consequence, the pistons are positioned at different heights in the axial direction.

The embodiments described above are by no means intended to restrict the invention but the invention can be modified within the scope of the claims in various ways. Accordingly, it is obvious that the invention or its parts need not be exactly similar to those shown in the drawings, but other solutions are possible as well. The housings accommodating the pistons can be made in any appropriate way, e.g., by drilling cylinders of suitable size within the frame. Correspondingly, the pistons can be formed by straight cylinder pins, etc.; and they need not be such as shown in the figures but pistons of other shape can also be used. Further, even though the drawings and the description related to them are concerned with an arrangement in which the pistons are divided into two groups so that some pistons are able to move towards the forward end of the drilling machine only to such an extent as is required for bringing the drilling machine to the percussion position, while the others are able to travel forwards therefrom e.g. substantially over the length of travel of the shank, it is equally possible to divide the pistons into more than two groups, so that one piston group travels part of the distance relative to the percussion point, and the rest travel a distance equal to that described in the above examples, that is, a still longer distance, whereby the return movement of the shank is deadened in a stepwise manner when the different piston groups are connected in operation one after the other. The hydraulic system used for adjusting the axial bearing may be connected in series with the lubrication system of the gear part of the shank, as shown in the figures; this, however, is not the only alternative but the adjustment system of the axial bearing and the lubrication system of the gear part of the shank can be made separate from each other, if this is regarded as necessary.

I claim:

1. An arrangement for an axial bearing in a drilling machine comprising a frame (6); a percussion device (1) fitted in the frame; a shank (2) positioned on an axial extension of the percussion device and having a percussion surface adapted to be struck by said percussion device; means for rotating the shank (2); and an axial bearing fitted in the frame to receive axial forces acting on the frame (6) through the shank (2), the axial bearing being formed by a plurality of pistons (4*a*, 4*b*) accommodated in axial housings formed in the frame (6) along a periphery circumscribing the shank (2) and interconnected with a conduit system (7), the pistons being further arranged to travel an axial distance axially so as to act on the shank (2) to force the shank towards a forward portion of the drilling machine under the influence of a hydraulic fluid acting on respective back surfaces of the pistons; and means for limiting the axial travel distance of a first group of said plurality of pistons towards the forward portion of the drilling machine relative to the axial travel distance of a second group of said plurality of pistons so that when said plurality of pistons are in a foremost position and the shank (2) is supported by said plurality of pistons (4*a*, 4*b*), the percussion surface of the shank is positioned substantially at its optimal percussion point, whereby the pressure of the hydraulic fluid acting on the back surface of the pistons (4*a*, 4*b*) at least during the drilling is arranged to be such that the total force exerted on the shank (2) by said plurality of pistons so as to force it forwards exceeds the feed force acting on the drilling machine during drilling.

2. An arrangement according to claim 1, wherein the axial travel distance of said first group of pistons from said optimal percussion point position of the shank (2) towards the forward portion of the drilling machine is substantially equal to an axial travel distance of the shank (2) from said optimal percussion point towards the forward portion the drilling machine, the first group of pistons (4*a*) being arranged to substantially follow axial movement of the shank (2).

3. An arrangement according to claim 1, wherein the axial travel distance of said second group of pistons from said optimal percussion point position of the shank (2) towards the forward portion of the drilling machine is limited so that it is shorter than a length of travel of the shank (2) towards the forward portion of the drilling machine.

4. An arrangement according to claim 1, and further comprising a support ring (8) between said plurality of pistons (4*a*, 4*b*) and the shank (2), a back surface of the support ring (8) being in contact with the front surface of said plurality of pistons (4*a*, 4*b*) and a front surface of the support ring (8) being in contact with a support surface on the shank.

5. An arrangement according to claim 1, wherein said means comprises a limiter ring (5) having limiter surfaces facing towards a rearward portion of the drilling machine, the limiter surface limiting the travel of said plurality of pistons (4*a*, 4*b*) towards the forward portion of the drilling machine when front surfaces of said plurality of pistons strike said limiter surfaces, and wherein said limiter surfaces include axially spaced surfaces at least at two points so that when said second group of pistons bears on their respective limiter surfaces and the shank (2) bears on said plurality of pistons (4*a*, 4*b*), the shank (2) is substantially at said optimal percussion point.

6. An arrangement according to claim 1, wherein at least some of said plurality of pistons (4*a*, 4*b*) in said first and second groups of pistons are provided at back surfaces thereof with projections (16, 18), a corresponding recess (17, 19) being formed in a hydraulic fluid conduit (7*b*) leading to the housing of the piston (4*a*, 4*b*) so that a gap remains between the projection (16, 18) and the recess (17, 19) for the flow of the hydraulic fluid, the projection (16, 18) and the corresponding recess (17, 19) forming a throttle means limiting the flow of the hydraulic fluid.

7. An arrangement according to claim 6, wherein the projections (18) on the back surfaces of said second group of pistons are shorter than the length of travel of the respective pistons (4*a*), the projections (18) being inserted into corresponding recesses (19) when the respective pistons (4*a*) travel towards a rearward portion of the drilling machine and rearwardly of said percussion point of the shank (2).

8. An arrangement according to claim 6, wherein projections in back surfaces of a second group of pistons are at least equal in length to the travel of said second group of pistons (4*b*), ends of said projections (16) being always in corresponding recesses (17), thus forming a continuously operated throttle means between the housing of said second group of pistons (4*b*) and the conduit (7*b*) for hydraulic fluid.

* * * * *